United States Patent [19]

Tarling

[11] Patent Number: 4,948,302

[45] Date of Patent: Aug. 14, 1990

[54] DISCHARGE APPARATUS FOR BROKEN-OFF FASTENER PARTS

[75] Inventor: Stephen R. Tarling, Hatfield, England

[73] Assignee: Avdel Systems Limited, Welwyn Garden, England

[21] Appl. No.: 305,649

[22] Filed: Feb. 3, 1989

[30] Foreign Application Priority Data

Feb. 5, 1988 [GB] United Kingdom ..... 8802580

[51] Int. Cl.[5] ..... B65G 51/08

[52] U.S. Cl. ..... 406/17; 406/177; 406/180

[58] Field of Search ..... 406/3, 16, 21, 19, 154, 406/164, 177, 180, 183, 17

[56] References Cited

U.S. PATENT DOCUMENTS

| | | | |
|---|---|---|---|
| 568,291 | 9/1896 | Batcheller | 406/177 |
| 1,944,769 | 1/1934 | Stoetzel | 406/17 |
| 2,135,355 | 11/1938 | Scanlan | 406/17 |
| 3,853,355 | 12/1974 | Buisson | 406/180 |

FOREIGN PATENT DOCUMENTS

| | | | |
|---|---|---|---|
| 640932 | 1/1979 | U.S.S.R. | 406/177 |
| 2031779 | 4/1980 | United Kingdom . | |

*Primary Examiner*—Sherman D. Basinger
*Assistant Examiner*—Stephen P. Avila
*Attorney, Agent, or Firm*—Oblon, Spivak, McClelland, Maier & Neustadt

[57] ABSTRACT

Discharge apparatus for discharging broken-off fastener parts (such as the stems of blind rivets) from fastener installation apparatus, comprises a passageway (13) along which the parts (37) are conveyed away from the installation apparatus (11) by a flow of air generated by a vacuum pump (14). The end of the passageway (13) remote from the installation apparatus (11) is normally sealed against the entry of air by a discharge valve (16). A broken-off part (37) approaching the discharge valve (16) is detected by an approach sensor (34) which is connected by a latching relay unit (33) and a control valve (25) to actuate a pneumatic ram (22) to open the discharge valve (16). At the same time the vacuum pump (14) is turned off to prevent a reverse flow of air through the open valve (16). The part (37) is discharged through the valve (16) and into a receptacle (19) which is outside the vacuum system. An exit sensor (35) beyond the valve (16) detects the discharged part and actuates the control valve (25) to close the discharge valve (16) and turn on again the vacuum pump (14).

9 Claims, 4 Drawing Sheets

DISCHARGE APPARATUS FOR BROKEN-OFF FASTENER PARTS

BACKGROUND OF THE INVENTION

The invention relates to discharge apparatus for discharging broken-off fastener parts from fastener installation apparatus. Fasteners in which a part of the fastener is broken off at the completion of installation of the fastener have been known and used for many years. One example is the blind breakstem rivet which is installed by pulling on the stem, part of which stem then breaks off. Of recent years there has been a requirement that fasteners are installed or placed more rapidly, i.e. with as little time as possible between the installation of successive fasteners by the stem installation apparatus. This has led to the development of automatically operated installation system in which fasteners are fed, automatically, in succession to an installation head, which may, for example, be mounted on the end of a robot arm. However, it is also necessary to remove the broken-off parts of the fasteners which result.

Such installation heads are commonly pneumatically operated, and it is convenient to use air-flow to feed new fasteners to the head and also to remove broken-off parts from the head. In order to minimize the number of connections, such as hoses, going to the installation head, it is convenient to provide the air-flow to remove the broken-off fastener parts from the head along a flexible hose by exhausting air from the hose at or near the end of the hose remote from the installation head. It has been proposed to connect the remote end of the hose to a substantially air-tight receptacle for broken-off fastener parts, from which receptacle air is exhausted to provide the air-flow along the flexible hose. However, with increasing fastener installation rates, it becomes necessary to open the receptacle more frequently to empty out the collected parts. Each opening destroys the vacuum in the receptacle and hose and stops the flow of air along the hose, which means that operation of the associated installation apparatus must be stopped until the receptacle has been closed again and re-exhausted by the air-exhaust means. Such delays are unacceptable in a continuously operating fastener installation system, for example used on a moving production line. In addition, it has been found that the level of vacuum applied to the sealed receptacle causes mechanical fatigue problems with the air seals on the door of the receptacle, and also with the body of the receptacle itself. The result is that the size of the receptacle has to be limited, which means that the receptacle has to be opened for emptying even more frequently.

SUMMARY OF THE INVENTION

The present invention is intended to help in overcoming such problems.

Accordingly, the present invention provides, in one of its aspects:

discharge apparatus for discharging broken-off fastener parts from a fastener installation apparatus, which discharge apparatus comprises:

a passageway along which broken-off fastener parts are conveyed away from the fastener installation apparatus;

air-exhaust means connected to the passageway for causing a flow of air therealong to assist in conveying broken-off fastener parts as aforesaid;

and discharge valve means, normally closed and sealing the passageway against the entry of air through the discharge valve means, but openable intermittently to allow the discharge of a broken-off fastener part from the passageway through the discharge valve.

Preferably the apparatus includes means for initiating the opening of the discharge valve means upon the approach thereto along the passageway of a broken-off fastener part and for closing it again after the broken-off fastener part has passed through the discharge valve means.

Preferably the apparatus includes detection means positioned adjacent the passageway on the approach side of the discharge valve means for detecting a broken-off fastener part approaching the discharge valve means.

Preferably the apparatus further includes second detection means positioned beyond the discharge valve means for detecting a broken-off fastener part which has passed through the discharge valve means.

Preferably the aforesaid means for opening and closing the discharge valve means comprises:

actuating means for moving the discharge valve means between its closed and open positions;

first detection means positioned adjacent the passageway on the approach side of the discharge valve means for detecting a broken-off fastener part approaching the discharge valve means;

second detection means positioned beyond the discharge valve means for detecting a broken-off fastener part which has passed through the discharge valve means; and valve control means, responsive to the first and second detection means and controlling the actuating means, to initiate opening of the discharge valve means when the first detection means detects an approaching broken-off fastener part, and to close the discharge valve means again when the second detection means detects that the broken-off fastener part has passed through the discharge valve means.

Preferably the apparatus includes means for disabling the air-exhaust means at least while the discharge valve means is open.

Preferably the apparatus includes means for disabling the air-exhaust means when the discharge valve means is opened and for re-enabling the air-exhaust means when the discharge valve means is closed again.

Preferably the valve control means also controls the air-exhaust means so as to disable it at least while the discharge valve means is open.

Preferably the passageway adjacent the discharge valve means on the approach side thereof is aligned substantially vertically.

The invention includes fastener installation apparatus in combination with discharge apparatus for discharging broken-off fastener parts therefrom as aforesaid.

BRIEF DESCRIPTION OF THE DRAWINGS

A specific embodiment of the invention will now be described by way of example and with reference to the accompanying drawings, in which.

DETAILED DESCRIPTION OF THE PREFERRED EMBODIMENTS

In this example the fastener installation apparatus is in the form of a fastener installation head 11, for installing automatically in succession blind breakstem rivets of the type available in many countries of the world under the registered trademark AVEX. Such rivets and installation heads are well known in the art of installing blind fasteners, and will not be described or illustrated in detail. Blind rivets each comprising a shell and a stem are installed by pulling on the stem of each rivet, and part of the stem breaks off and has to be removed from the installation head. Such broken off parts will hereinafter be referred to as stems.

Figure 1:
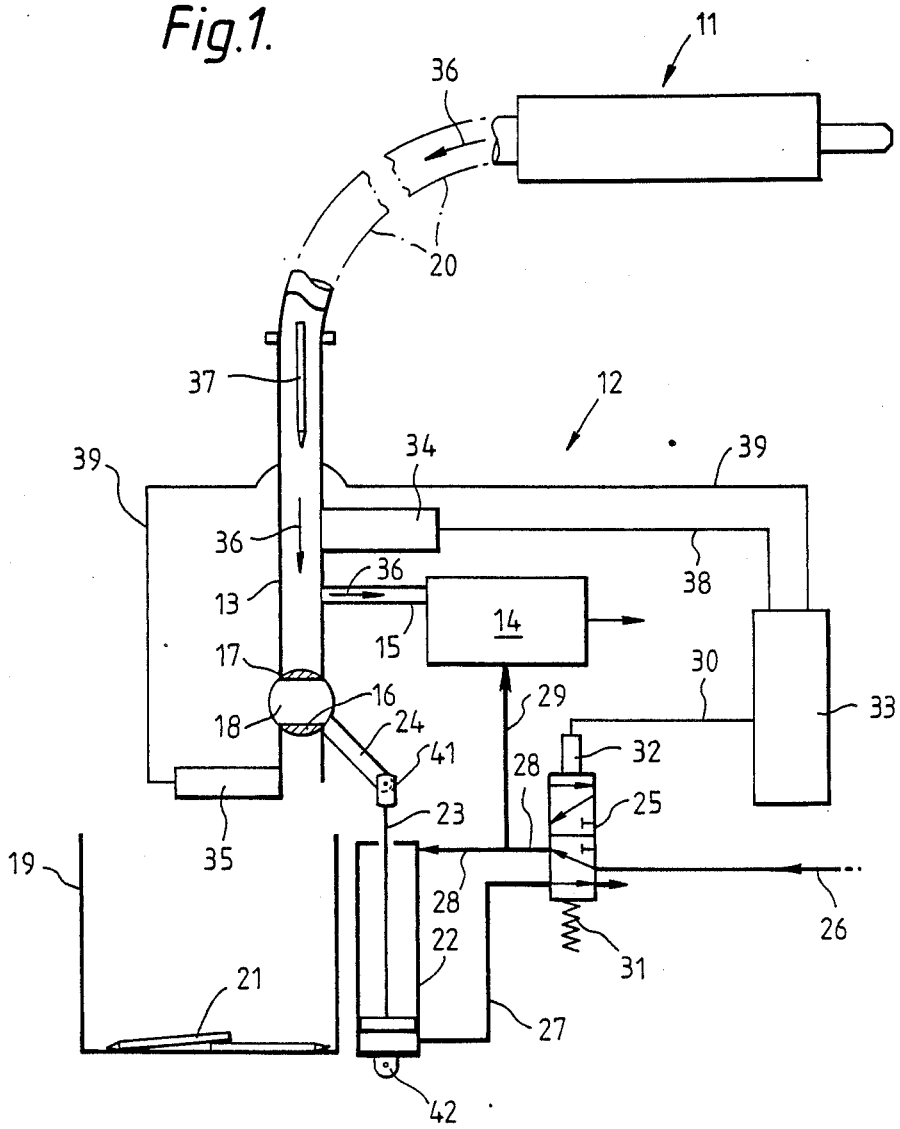
FIGS. 1 and 2 show schematically a discharge apparatus and its associated fastener installation apparatus, FIG. 1 showing the discharge valve means closed and FIG. 2 showing the discharge valve means open.
Figure 2:
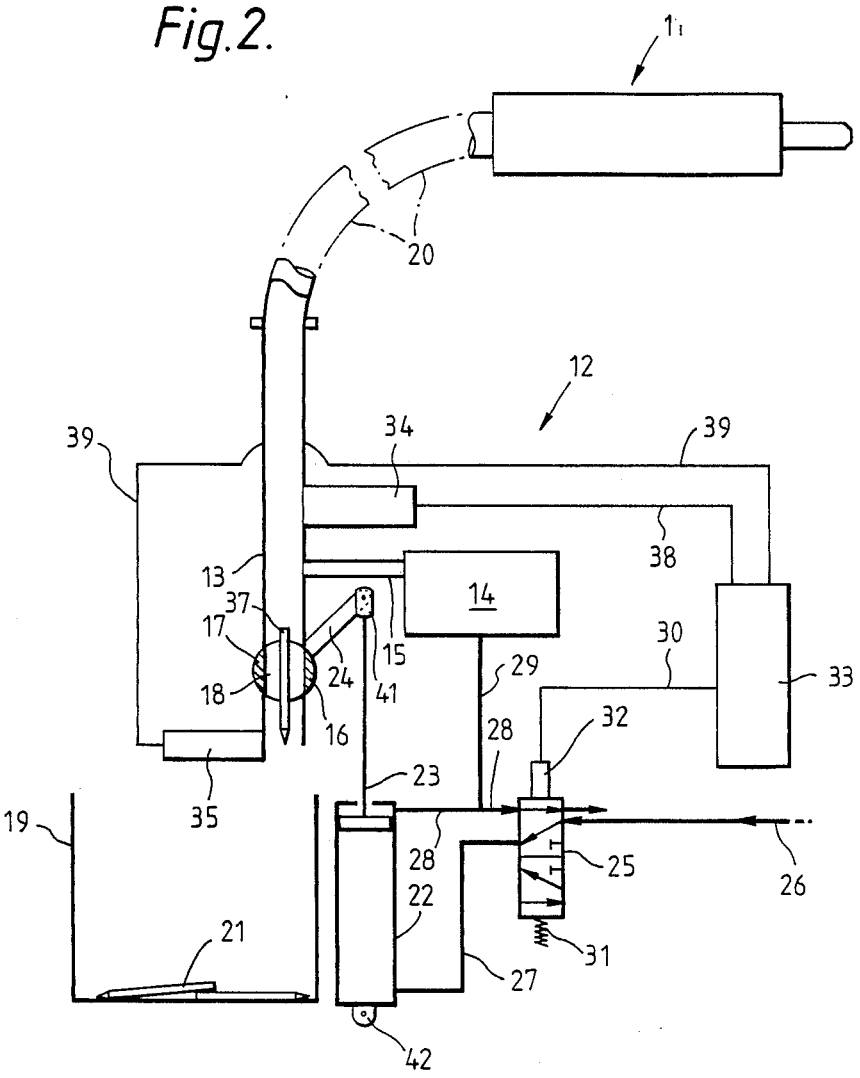

Referring first to FIGS. 1 and 2, the stem discharge apparatus 12 essentially comprises a passageway 13 along which stems are conveyed away from the head 11; air-exhaust means in the form of a vacuum pump 14 connected to the passageway 13 by a tee-connection 15 for causing of air along the passageway 13 to convey stems along it; and a discharge valve 16 at or near the end of the passageway 13, which valve is normally closed but is openable intermittently to allow stems to be discharged from the passageway.

In this example the passageway 13 in the discharge apparatus is provided by a vertically - orientated rigid plastics pipe 13, the upper end of which is connected to one end of a flexible hose 20. The other end of the hose 20 is connected to the installation head 11, for conveying stems away from the head. In this example, the hose 20 connecting the installation head 11 to the discharge apparatus is disconnectable from the discharge apparatus. However, the hose 20 could extend from the head 11 into the discharge apparatus 12 as far as the valve 16 if desired.

The vacuum pump 14 is an air flow-operated venturi extractor.

The discharge valve 16 is provided by a ball valve in the passageway 13. The valve comprises a ball 17 having a bore 18 through it. The ball is sealed into a seating in which it can be rotated about an axis at right-angles to the axis of the passageway 13, between a closed position (FIG. 1) in which the body of the ball seals the passageway, and an open position (FIG. 2) in which the bore is aligned with the passageway. The part of the passageway 13 adjacent the valve is aligned vertically, and below the valve there is provided a receptacle (e.g. a bin) 19 for receiving stems 21 discharged through the valve.

Actuating means for moving the discharge valve 16 between its open and closed positions is provided by a double-acting pneumatic ram 22, the piston rod 23 of which is connected by a clevis 41 to a crank arm 24 secured to the valve ball 17. The ram 22 can pivot on a clevis 42 at the end remote from the piston rod 23.

The pneumatic ram 22 is controlled by a five port, two way, solenoid operated, air assisted, spring return, changeover valve 25. This is arranged to feed compressed air from an input 26 to one end or other of the ram 22 via pipes 27, 28, to close or open the discharge valve 16. The pipe 28, which is pressurized to close the discharge valve, is also connected to supply compressed air via a pipe 29 to the vacuum pump 14.

The position of the pneumatic changeover valve 25 is controlled by its return spring 31 and its solenoid 32. The solenoid 32 is in turn controlled by a latching relay unit 33 to which it is connected by an electrical lead 30. This unit 33 is also connected by an electrical lead 38 to a first or approach sensor 34 positioned adjacent the passageway 13 at a position spaced away from the discharge valve 16 on the approach side thereof, and by an electrical lead 39 to a second or exit sensor 35 positioned adjacent the discharge valve 16 but on the discharge or exit side thereof. Each sensor 34 and 35 senses the presence of a stem as the stem passes the sensor. Where the stems are of steel or other ferromagnetic material, the sensors may conveniently be magnetic proximity detectors.

The normal operating condition of the discharge apparatus is as illustrated in FIG. 1. (In FIGS. 1 and 2, air flow is indicated by conventional arrows or arrow heads). The discharge valve 16 is closed, since the latch unit 33 is not energising the solenoid 32, and the spring 31 is holding the valve 25 to feed compressed air along pipe 28 to hold the ram 22 in the "valve closed" position, and also along pipe 29 to run the vacuum pump 14. The vacuum pump 14 sucks air through connection 15 to cause an airflow along passageway 13 and hose 20, from the installation head 11 towards the vacuum pump 14, as indicated by arrows 36. Because the valve 16 is closed, air is not sucked out through it.

When a stem is ejected from the installation head 11, the air flow conveys it along the hose 20 and into the passageway 13. FIG. 1 illustrates a stem 37 approaching the valve 16. When the stem 37 reaches the approach sensor 34, the approach sensor gives an electrical output signal to the latch unit 33 which initiates closing of the discharge valve. The electrical output signal causes the unit 33 to start, and continue, to energise the solenoid 32 of changeover valve 25. This changes to the position shown in FIG. 2, in which the compressed air and vent connections, via pipes 27 and 28, to the ram 22 are interchanged. The ram changes position and moves the discharge valve 16 to its open position. The valve 25 also turns off the vacuum pump 14 by shutting off the supply of compressed air to it along pipe 29. The action of opening the discharge valve 16 and shutting off the vacuum pump 14 stops the air flow along the hose 20 and passageway 13, but the stem 37 continues, due to its momentum and the force of gravity, to and through the open valve 16 and down into the receptacle 19. The stem is thus discharged from the passageway.

When the stem 37 reaches the exit sensor 35, the latter gives an electrical output to latch unit 33. This causes the unit 33 to de-energise the solenoid 32 of valve 25. This causes the ram 22 to move the discharge valve 16 to close, and the vacuum pump 14 to restart, thus re-establishing the air-flow along the passageway 13 and hose 20, ready to convey the next stem away from the installation head 11.

The ram 22 may be provided with suitable damping means (e.g. air-flow restrictors ) to reduce the shock as its piston moves.

Air needs to be exhausted only from the relatively small volume of space within the passageway 13 and hose 20 (and any connected passageways within the head 11), so that the air-flow is very quickly re-established. The shutting off of the vacuum pump 14 while the discharge valve 16 is open saves energy and reduces noise. Moreover, if the vacuum pump 14 were running while the discharge valve 16 is open, a reverse air-flow through the discharge valve bore 18 would be created, which might slow down or interfere with the passage of the stem 37 through the discharge valve.

Figure 3:
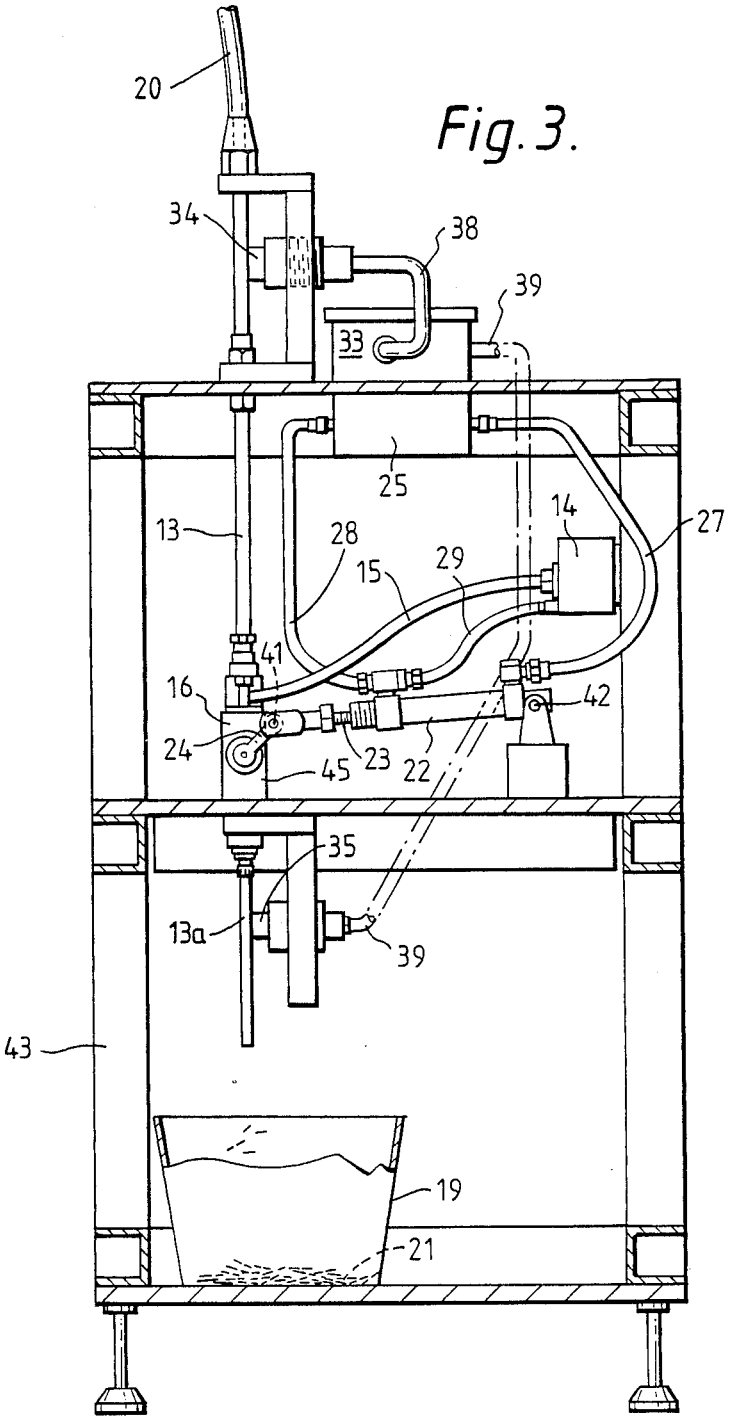
FIG. 3 is a side elevation showing the construction of the actual apparatus.
Figure 4:
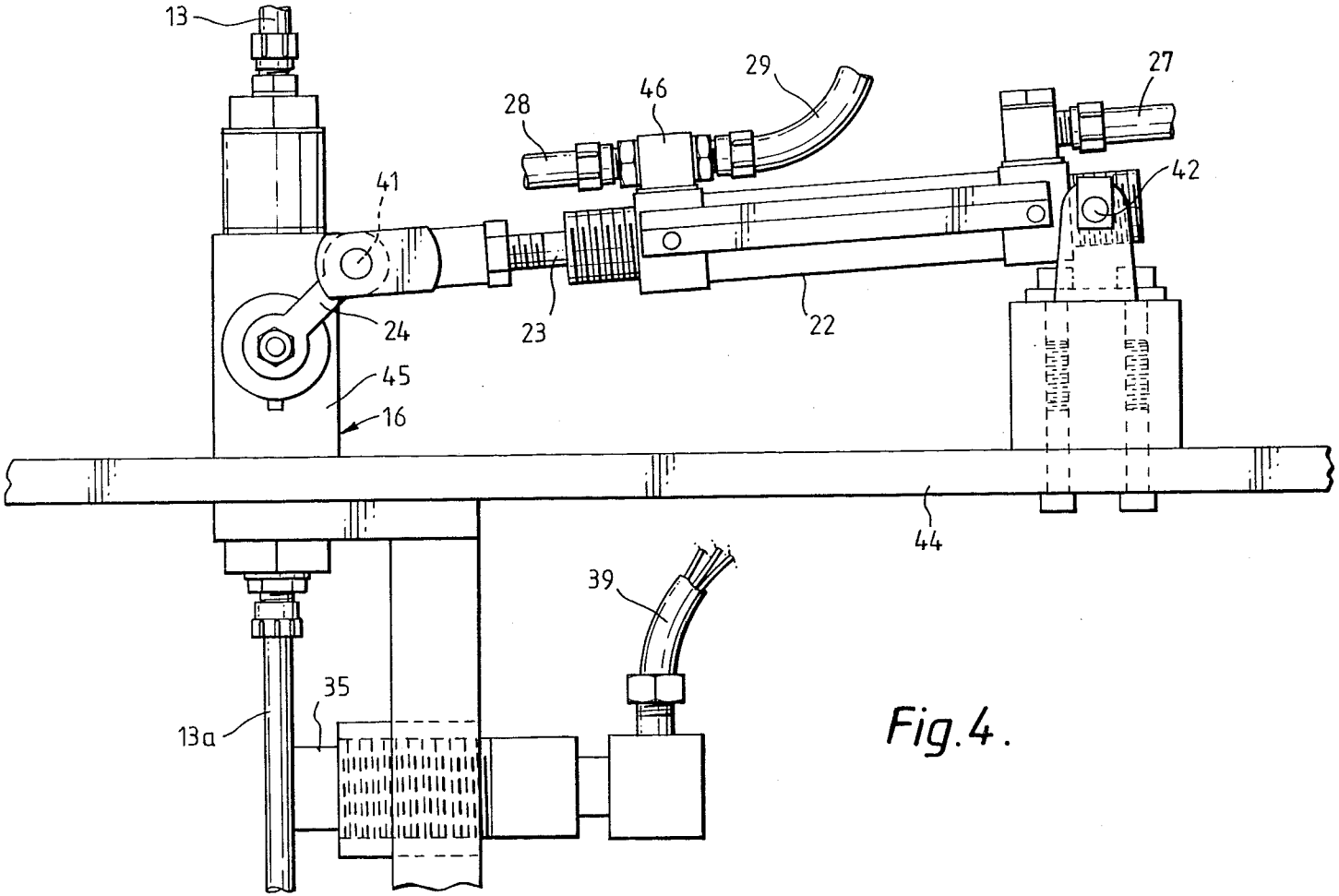
FIG. 4 is an enlarged elevation of the discharge valve means and its associated actuating means and exit sensor.

The foregoing description with reference to FIGS. 1 and 2, which illustrate the apparatus schematically the operation of the apparatus, also applies to FIGS. 3 and 4, which show the construction of the apparatus, the same parts being indicated respectively by the same reference numerals.

Constructional features illustrated in FIGS. 3 and 4, but not in FIGS. 1 and 2, include a rigid cabinet 43 into which the apparatus is built. The pneumatic ram 22 is arranged substantially horizontally. The discharge valve 16 is provided by a tubular metal housing 45 which provides the seating for the ball 16 (not visible in FIGS. 3 and 4).

The compressed air pipes 27, 28 and 29 are provided as flexible hoses. The hose 29, feeding compressed air to drive the vacuum pump 14, is connected to the hose 28 through a common coupling 46 on the ram 22.

The passageway 13 below the valve 16 is provided by a further pipe 13*a*. The exit sensor 35 is adjacent the pipe 13*a*, at an appropriate distance from the valve 16. The stem collection bin 19 stand on the floor of the cabinet under the bottom end of the pipe 13*a*. Since the bin 19 is not within the vacuum system, it can be quickly removed and replaced by an empty bin, when it is full of stems. If it is not emptied, stems could pile up in it to the point where they block the exit from the pipe 13*a* so that a stem is held opposite the exit sensor 35. This would cause the exit sensor 35 to generate a continuous electrical output. The latching unit 33 is arranged to respond to such a continuous output by giving a "bin full" signal (e.g. by light or sound) to the operator, and/or maybe by causing temporary interruption of the rivet installation apparatus 11 by means of a suitable connection.

It will be apparent that the distances by which the approach sensor 34 and exit sensor 35 are spaced away from the discharge valve 16 need to be selected to ensure that the valve 16 opens and closes at the correct times in relation to the movement of the stem 37 towards and through the valve. Detection of the approaching stem by the sensor 34 initiates opening of the discharge valve 16, but the changeover valve 25 and ram 22 take a finite time to move, so that there is a time delay before the valve 16 reaches its open position. There is less time delay before the air exhaust flow from the vacuum pump 14 ceases. This is advantageous, since it is possible if there were a transverse air flow out of the passageway 13 into the tee-connection 15 when a stem passes the tee-connection, the transverse air-flow might pull the passing stem 37 against the sidewall of the passageway and impede the progress of the stem.

It should be noted that a ball valve as used in this example has the advantage that it will still allow a stem to be discharged even if the stem makes contact with the rotating ball before the valve is fully open, since the contact of the stem does not prevent movement of the valve. The impact and contact of the stem may cause pits or scratches in the front face of the ball, but the back face will not be damaged and its sealing properties will be unimpaired.

The invention is not restricted to the details of the foregoing example. For instance, the vacuum pump 14 could be disabled by providing a valve in the exhaust connection 15 which shuts off the exhaust air flow from the passageway 13 when the discharge valve 16 is open, the vacuum pump being left running all the time.

Specific components of the discharge apparatus may be of any suitable type. For example, the sensors 34 and 35 could be optical sensors. The latching unit 33 could be replaced by an electronic logic unit.

The solenoid valve 25 need not be spring return but could be solenoid-operated in both directions, still preferably air-assisted.

The pneumatic ram 22 could be replaced by an electrically-powered solenoid actuator.

Vertical alignment of the passageway 13 is believed to give the most efficient and reliable operation of the apparatus, but it would be possible for the passageway to be at an angle to the vertical if necessary.

It may be possible to omit the second detection means on the exit side of the discharge valve means, and to arrange for the valve means to be closed at a predetermined time interval after it has been opened. It might be possible to omit the valve actuating means, and to provide the discharge valve means in the form of, for example, a flap member which is normally held closed against an aperture by means of the vacuum in the passageway and, maybe, a spring, and which is opened to discharge a broken-off fastener part by the impact and momentum of the part on the flap member, although this might cause problems with sealing the valve in the closed position.

The discharge system may be used to discharge broken-off fastener parts of other types, for instance from AVSEAL (RTM) plugs or JO-BOLT (RTM) blind bolts.

I claim:

1. Discharge apparatus for discharging broken-off fastener parts from a fastener installation apparatus, which discharge apparatus comprises:

a passageway having one end connected to said fastener installation apparatus, whereby broken-off fastener parts are conveyed along said passageway away from the fastener installation apparatus;

air-exhaust means connected to the passageway for causing a flow of air therealong to assist in said conveying of broken-off fastener parts;

and discharge valve means normally sealing the passageway against the entry of air through the discharge valve means but openable intermittently to allow the discharge of a broken-off fastener part from the passageway.

2. Apparatus as claimed in claim 1, including means for initiating the opening of the discharge valve means upon the approach thereto along the passageway of a broken-off fastener part and for closing it again after the broken-off fastener part has passed through the discharge valve means.

3. Apparatus as claimed in claim 2, comprising detection means positioned adjacent the passageway on the approach side of the discharge valve means for detecting a broken-off fastener part approaching the discharge valve means.

4. Apparatus as claimed in claim 3, further comprising second detection means positioned beyond the discharge valve means for detecting a broken-off fastener part which has passed through the discharge valve means.

5. Apparatus as claimed in claim 2, in which the means for opening and closing the discharge valve means comprises:

actuating means for moving the discharge valve means between its closed and open positions;

first detection means positioned adjacent the passageway on the approach side of the discharge valve means for detecting a broken-off fastener part approaching the discharge valve means;

second detection means positioned beyond the discharge valve means for detecting a broken-off fastener part which has passed through the discharge valve means; and valve control means, responsive to the first and second detection means and controlling the actuating means, to initiate opening of the discharge valve means when the first detection means detects an approaching broken-off fastener part, and to close the discharge valve means again when the second detection means detects that the broken-off fastener part has passed through the discharge valve means.

6. Apparatus as claimed in claim 1, including means for disabling the air-exhaust means at least while the discharge valve means is open.

7. Apparatus as claimed in claim 2, including means for disabling the air-exhaust means when the discharge valve means is opened and for re-enabling the air-exhaust means when the discharge valve means is closed again.

8. Apparatus as claimed in claim 5, in which the valve control means also controls the air-exhaust means so as to disable it at least while the discharge valve means is open.

9. Apparatus as claimed in claim 1, in which the passageway adjacent the discharge valve means on the approach side thereof is aligned substantially vertically.

* * * * *